US007595738B2

(12) United States Patent
Krock et al.

(10) Patent No.: US 7,595,738 B2
(45) Date of Patent: Sep. 29, 2009

(54) METHOD AND APPARATUS FOR EMERGENCY MAP DISPLAY SYSTEM

(75) Inventors: Richard E. Krock, Naperville, IL (US); Gerald W. Pfleging, Batavia, IL (US); George Wilkin, Bolingbrook, IL (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 352 days.

(21) Appl. No.: 11/586,829

(22) Filed: Oct. 26, 2006

(65) Prior Publication Data

US 2008/0104631 A1 May 1, 2008

(51) Int. Cl.
*G08G 1/09* (2006.01)

(52) U.S. Cl. ..... 340/905

(58) Field of Classification Search ..... 340/905, 340/539.14, 995.1, 525, 601; 725/32, 33
See application file for complete search history.

(56) References Cited

U.S. PATENT DOCUMENTS 6,441,732 B1 * 8/2002 Laitsaari et al. ..... 340/539.1
2002/0161830 A1 10/2002 Mukaiyama et al.
2003/0212485 A1 11/2003 Michmerhuizen
2004/0102895 A1 * 5/2004 Thayer et al. ..... 701/200
2004/0220726 A1 11/2004 Jin et al.
2005/0099323 A1 5/2005 Hirose
2005/0190053 A1 * 9/2005 Dione ..... 340/500
2007/0136743 A1 * 6/2007 Hasek et al. ..... 725/33
2007/0225898 A1 9/2007 Pfleging et al.
2007/0298758 A1 * 12/2007 Verma et al. ..... 455/404.1

* cited by examiner

*Primary Examiner*—Phung Nguyen

(57) ABSTRACT

A method and system for delivering emergency directions is provided. The disclosure includes the government delivering a warning message for potential evacuees on a gas station pump or automated teller machine point of service display screen. The method includes receiving an emergency alert from a government entity, constructing a warning message, including an evacuation route based at least in part on real time traffic data and the location of the display screen and displaying the warning message on the point of service display screen. In one embodiment of the disclosure, the warning message is authenticated. In another embodiment of the disclosure, the warning message is continuously updated to provide an effective escape route for evacuees.

19 Claims, 2 Drawing Sheets

METHOD AND APPARATUS FOR EMERGENCY MAP DISPLAY SYSTEM

BACKGROUND OF THE INVENTION

This disclosure relates to a method and apparatus for displaying evacuation information on non-traditional display devices. In this regard, the disclosure relates to a system and method useful for aiding emergency evacuation through the use of automated teller machines (ATMs) and fuel pump displays. In one form, common emergency information such as evacuation routes, travel times and such can be displayed on these non-traditional devices.

While this disclosure is particularly directed to the art of emergency map display, and will be thus described with specific reference thereto, it will be appreciated that the disclosure may have other usefulness in other fields and applications. For example, this disclosure may be used to map non-emergency situations or to aid potential users in finding any specified destination.

By way of background, hurricanes in recent years have educated the public as to the importance of instructions and maps for routes out of possible effected areas. People evacuating may not be familiar with the local area and often times in an emergency situation, familiar routes become impassible due to high traffic volume. Furthermore, with other emergency situations, such as other weather related emergencies and/or terrorist attacks, etc., widespread panic may make it difficult to coordinate a proper evacuation.

When a disaster strikes, and an individual chooses to evacuate, he or she will often attempt to procure gas at a local service station, and/or attempt to get cash via a local ATM. Many ATMs and service station pumps are beginning to add large screen color liquid crystal display (LCD) technology. Even point of service (POS) terminals without this type of technology have the ability to display text messages. However, even with this technology in place, there remains a need in the industry to link government issued warnings, with these displays. One of the shortcomings of the currently implemented system is that although government entities do have direct access to media, such as radio and television networks, they do not have the same direct access to the private service infrastructure, such as, ATMs and service station pumps.

It is desirable to have a system and a method that will aid in the delivery of emergency directions from government entities to potential evacuees. Furthermore, it is also desirable to provide potential evacuees with an option to print hard copies of the governmental warning along with other vital information such as preferred evacuation routes. Furthermore, it is also desirable for this information to be quickly and easily accessible, especially when the emergency is taking place.

The present invention contemplates a new and improved system and method that resolves the above-referenced difficulties and others.

SUMMARY OF THE INVENTION

A method and apparatus for delivering emergency directions from a government entity to potential evacuees on a gas pump or automated teller machine, point of service display screen is provided.

In one aspect of the present invention is a method that comprises receiving an emergency alert from a government entity constructing a warning method including an evacuation route based at least in part on real time traffic data and the location of the display screen and displaying the warning message on the point of service display screen.

In another aspect of the present disclosure, the method includes authenticating the emergency alert.

In another aspect of the present disclosure, the method when constructing a warning message, including an evacuation route, based at least on real time traffic data, that the real time traffic data is derived at least in part from wireless communication network traffic.

In another aspect of the present disclosure, the method includes updating the warning message based at least in part on real time traffic data.

In another aspect of the present disclosure, the method includes constructing a warning message that includes the travel time necessary in order to reach the user's destination.

In another aspect of the present disclosure, the method includes displaying alternate service stations on the evacuation route.

In another aspect of the present disclosure, the method includes when displaying the warning message that the warning message includes a graphical map.

In another aspect of the present disclosure, the method includes printing the warning message.

In another aspect of the present disclosure, the method includes facilitating two way communication between the point of sale entity and the government entity.

In another aspect of the present disclosure, the method includes receiving an authorization message from a government entity, receiving an emergency message from the government entity with the emergency message including an evacuation route which is based at least in part on specific and immediate location of the reader and posting the emergency message at that specific and immediate location.

In another aspect of the present disclosure, the method includes updating the evacuation route based at least in part on traffic data.

In another aspect of the present disclosure, the method includes updating the evacuation route based at least in part on traffic data while the traffic data is developed through wireless communications data.

Another aspect of the present disclosure includes printing at least part of the emergency message.

In another aspect of the present disclosure, a system for delivering emergency directions from the government to potential evacuees is provided. The system includes a mapping module, a traffic module configured to gauge traffic flow, a server module configured to receive information from a mapping module and the traffic module and derive an evacuation route based at least in part on the traffic flow and a point of service display screen configured to display an emergency message including evacuation route.

In another aspect of the present disclosure, the system includes the traffic module gauging traffic flow through monitoring wireless network traffic.

In another aspect of the present disclosure, the system includes a printer configured to print at least part of the message.

In another aspect of the present disclosure, the system further includes that the emergency message includes an estimated travel time till the destination.

In another aspect of the present disclosure, the system further includes that the emergency message be displayed prior to the associated gas pump or associated automatic teller machines and normal operation.

In another aspect of the present disclosure, the system further includes that the emergency message must be accepted prior to the normal operation of the associated gas pump or the associated automated teller machine.

In yet another aspect of the present disclosure, the system includes that the emergency message includes a graphical map.

Further scope to the applicability of the present disclosure will become apparent from the detailed description provided below. It should be understood however, that the detailed description and specific examples, while indicating an exemplary embodiment of the disclosure are given by way of illustration only. Since various changes and modification within the spirit and the scope of the present disclosure will become apparent to those skilled in the art.

DESCRIPTION OF THE DRAWINGS

The present disclosure exists in the construction, arrangement, and combination of the various parts of the device, and steps of the method, whereby the objects contemplated are attained as hereinafter more fully set forth, specifically point out in the claims, and illustrated in the accompanying drawings in which:

DETAILED DESCRIPTION

The presently described embodiments are directed, in at least one form, to a system and method of delivering emergency directions from the government to potential evacuees. The system and method has a function that will show the users of a point of service (POS) terminal the most efficient route away from a potential disaster area. However, it is contemplated that the user may provide input, including but not limited to, a specific destination and/or route, which can also be mapped out and taken into account when detailing a route of escape. Through this disclosure, the route calculated may not be the most direct, however, it is designed to direct an end user to get from their current position to a position of safety. Furthermore, the system takes into account current traffic conditions and updates these conditions in real time to provide accurate and efficient mapping.

Figure 1:
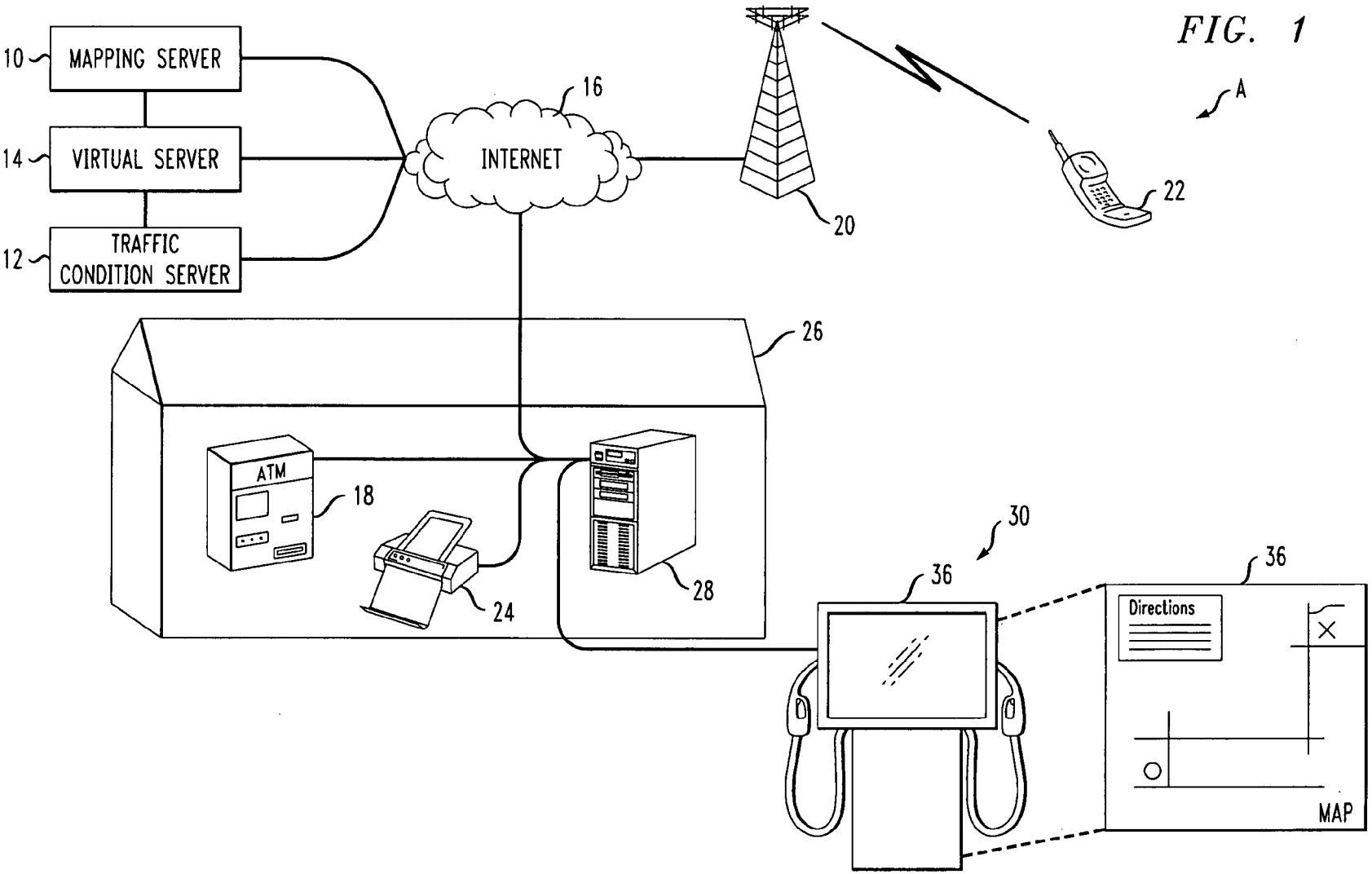
FIG. 1 is a representative view of the overall network in which the presently described embodiments may be implemented.

Referring now to the drawings wherein the showings are for purposes of illustrating the exemplary embodiments only and not for purposes of limiting the claimed subject matter, FIG. 1 provides an overall view of a system into which the presently described embodiments may be incorporated. As shown generally, FIG. 1 illustrates a network A. The network A includes a variety of elements that are in communication with one another and/or the internet 16. In particular, a mapping server 10 is in communication with a virtual server 14. Also, a traffic condition server 12 is in communication with the virtual server 14. It should be appreciated that this configuration may take on a variety of forms. Therefore, this disclosure should not be limited to the implementation of any one configuration. For example, the mapping server and/or traffic condition server could be in communication with one another or a different server which is in communication with a virtual server 14. Furthermore, many traffic condition servers 12 could be in communication with virtual server 14. The function of any of these elements may also be split among a variety of different elements.

Still referring to FIG. 1, a virtual server is in communication with the internet 16. Again, it should be appreciated that the virtual server 14 need not be in communication with the internet, however, may be in communication with a network provider or a private service. Internet 16 is also in communication, for example, with a tower which is in communication with multiple cell phones 22.

As shown, a POS control system 28 is in communication with the internet 16 and is also linked to a printer 24, an ATM 18, and a gas pump 30. The gas pump 30 contains within it a display 32, which in this embodiment is displaying a map 36. The gas pump 30 may also be linked to a printer. The ATM may also contain a display and/or a printer similar to that shown at 36.

Still referring to FIG. 1, the mapping server 10 is used in order to create a map for a user to travel from his/her current position to a desired destination. Mapping servers are known in the art and use a variety of methods to map different kinds of routes.

The traffic condition server 12 is used to measure traffic flow in a given area. The traffic flow can be measured through a variety of different methods. In one embodiment, the traffic flow is measured through communicating with a tower 20 which can track the different cell phones, PDAs, etc. 22 in a given area. This is not a perfect measurement, but it is one useful form in order to estimate the traffic flow. Other embodiments are detailed in the discussion of FIG. 2.

The virtual server 14 may be used to gather the information from the mapping server 10 and the traffic condition server 12 and devise an effective evacuation route with those given inputs. The virtual server 14 may also accept user inputs to determine an effective evacuation route. The virtual server 14 would also continue to monitor traffic conditions to continuously customize effective evacuation routes. In one embodiment, the virtual server 14 is in constant communication with the traffic condition server 12 to continuously update effective evacuation routes. In another embodiment, the virtual server 14 is in periodic communication with the traffic condition server to periodically update the effective evacuation routes. In any form, the virtual server 14 will continue to suggest that traffic be moved to routes that are less congestive through the inputs of the traffic condition server 12 and mapping server 10.

The communications cloud 16, which is labeled the internet, is a form of communication path or network between the virtual server 14, the POS control station 28, the tower 20, the traffic conditioning server 12, and a mapping server 10. It should be noted that it is not required that the internet be the link in order to facilitate communication. Communication can also take place through an intranet, a local service provider, or any other form of communication path or network.

The POS control station 28 is responsible for receiving the communication from the virtual server 14, and processing and/or converting that communication to a form that a user can interpret. In this embodiment, the POS control station 28 is in communication with a printer 24 positioned, for example, inside of a building 26. The POS control station 28 is responsible for transferring the data into human readable form. In one embodiment, the POS control station 28 would send this information to the printer 24, which in turn would print out the warning message. The POS control station 28 may also have in place a fire wall to prevent unauthorized communications. For example, the fire wall may prevent a hacker from infiltrating the system.

The POS control system 28 may also be password protected so, for example, when a government entity issues an official warning, that entity would need to enter the password in order to initiate the message. In this instance, without the password, the message simply would not be relayed to the printer and/or display.

The printer 24 would be used to print the warning message. In this instance, during an emergency situation, a clerk in the bank or gas station building would be able to post the warning message for anyone to see when they approach the building. The POS control station 28 could also send the warning message to the gas pump 30 or ATM 18.

In the instance where the POS control station 28 forwards the message to an ATM 18, the ATM 18, although shown inside of the building 26, can be in any given location. For example, the ATM may not be at a service station, but may be at a bank, in which case the POS control station 28 may also be at a nearby banking branch. Regardless of the location of the ATM 18, it will still be in communication with some sort of POS control station 28. When the ATM 18 receives the warning message, it may display the message through a variety of methods. In one embodiment, the ATM 18 displays the warning message on its screen. In another embodiment, the ATM 18 prints the warning message on a slip of paper, for example, through use of the printer that it typically uses to print receipts. In yet another embodiment, the ATM 18 may be capable of using voice in order to communicate the warning message to a user. It should also be noted that the warning message may include specific instructions including an emergency escape route in which case the ATM 18 may display a route on; for example, a map pinpointing that escape. The emergency message could also include landmarks such as service stations, hotels, etc. on the way to the destination.

In the same manner that the POS control station 28 could forward information to the ATM 18, it could also forward the information to a gas pump 30. Similarly, the gas pump 30 may display a map 36 on its screen 32 or the gas pump 30 could use voice in order to communicate the warning message.

Through either medium, gas pump 30 or ATM 18, the warning message may include a form where a user could purchase or be given a printout stating the warning message, including an effective route to safety. Furthermore, either the ATM 18 or gas pump 30 could provide a form in which the user could communicate a desire for a different route or a new destination. In this form, the display would accept user input in order to map an efficient route. In another form, this warning message, including an effective route to safety, could be sent to a user's hand held device 22. This hand held device 22 could include a PDA, laptop, mobile unit, etc. The route could even be emailed or saved on any other external storage device including a floppy disc, a jump drive, etc. The information could also be transferred via radio frequency (RF) or to a satellite radio channel. The waning message may include a graphical map or it may simply be direction or instructions.

In one embodiment, the warning message will be displayed before the ATM 18 or gas pump 30 is to begin normal operation. In this example, the user would be forced to acknowledge that the message was received before the ATM 18 or gas pump 30 would begin normal operation. In some instances, the user would be required to click or touch an accept button.

Figure 2:
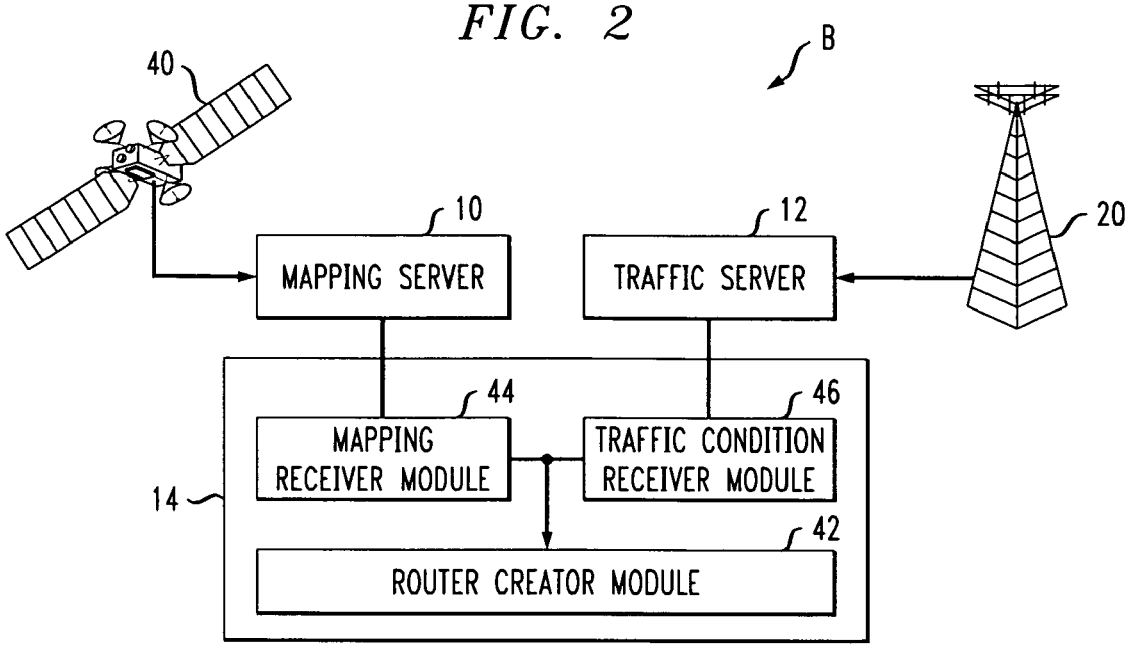
FIG. 2 is a functional diagram of a portion of the system according to the presently described embodiment.

FIG. 2 illustrates a more detailed view of part of the system A for delivering emergency directions from the government to potential evacuees on a gas pump or automated machine POS display screen. More particularly, FIG. 2 shows the modules included in the virtual server 14. This system B includes a mapping receiver module 44, a traffic condition receiver module 46 and a route creator module 42. It should be appreciated that this system B may be implemented using a variety of software tools and hardware configurations. Furthermore, these modules and/or servers may be implemented in a centralized single server or distributed throughout the system.

As FIG. 2 shows, the mapping receiver module 44 may get its mapping information from the mapping server which in turn may gather its information from satellite 40 or any viable outside source. The mapping receiver module 44 is used for providing mapping information to the route creator module 42. It should be noted, however, that the mapping information can be provided via the internet, the intranet or any other mapping source.

The traffic condition receiver module 46 may be used to provide current traffic information. This may be done in real time through use of network traffic data. The network traffic data may be provided from the traffic server which derives its data from the satellite 40, a communication tower 20, or any other reasonable means. As noted above, the traffic tower 20 may be used to track different cell phones, PDAs, etc. in a given area. It should again be noted that this may be not be a perfect measurement for tracking the amount of vehicles in any given area, however, it may be used to provide a sufficient estimate for the amount of traffic flow. Furthermore, through the use of wireless communications, traffic flow can be monitored by not only measuring the number of vehicles in the area, but can also measure the speed in which these vehicles are moving. For example, when tracking a cellular phone 22, it may be useful to know how fast it is moving and in what direction it is moving. This can be done by using an iLocator™ service, triangulation method, or a variety of other methods known in the art. In this embodiment, traffic congestion can be monitored by taking in to account the speed in which the traffic is moving.

The traffic condition server 12 can also measure traffic flow through the use of satellites. In this instance, the traffic condition server 12 may be in communication with a satellite that has the ability to track traffic data through any method known in the art. The traffic condition server 12 could also take input from monitoring traffic flow through conventional means such as helicopters, traffic counters, eye witnesses etc.

The route creator module 42 may be used to gather the information from the mapping receiver module 44 and/or traffic condition receiver module 46. The route creator module 42 would then accept the inputs and determine an effective evacuation route. The route creator module 42 is equipped to communicate its findings to the POS control system (FIG. 1, 28), which in turn would use the information to display the emergency message on a POS display screen (FIG. 1, 32). The emergency message may include such information as estimated travel time to the destination and/or an option for printing the emergency message.

Figure 3:
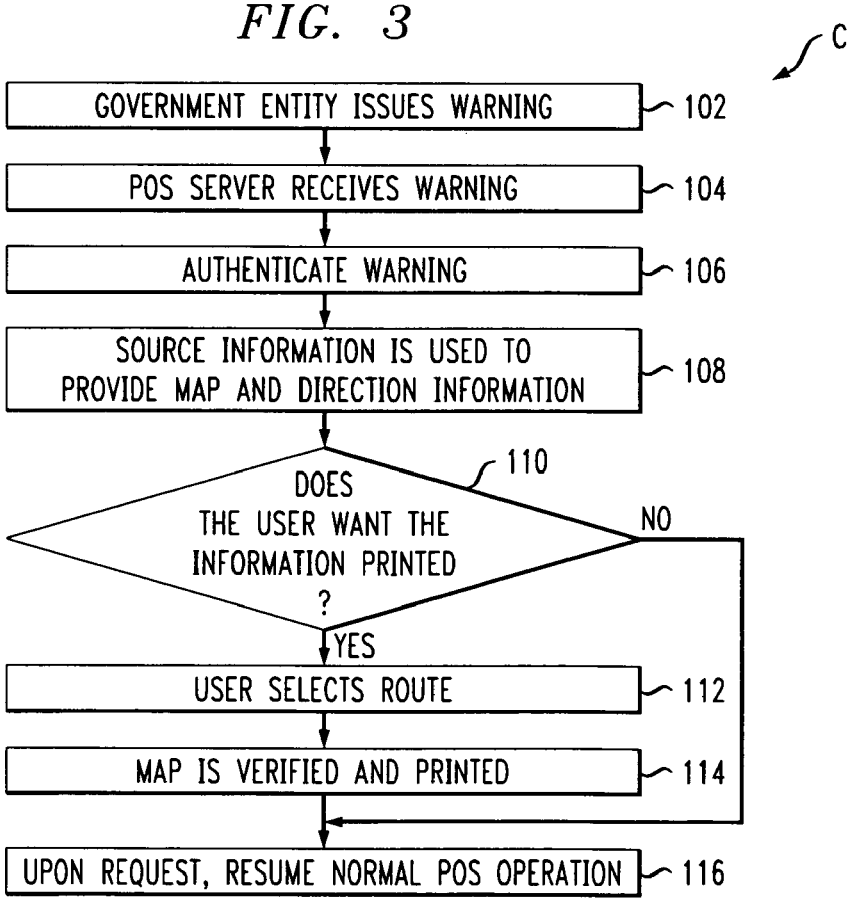
FIG. 3 is a flow chart illustrating a method according to the presently described embodiments.

FIG. 3 illustrates a method C for delivering emergency directions from the government to potential evacuees on a point of service display screen. It should be appreciated that this method may be implemented using a variety of software routines and hardware configurations. For example, the routines may be centralized on a single server as controlled and/or distributed throughout the system.

The method C includes the government entity issuing a warning (at 102). In one embodiment, the government warning will come with specific instructions on how evacuation is to be handled. It could also include whether or not the evacuation is mandatory. The warning message may also include the reasoning for evacuation, i.e., weather, terrorist threat, etc.

Next, the POS control station 28 (in FIG. 1), receives the warning (at 104), followed by authenticating the warning message (at 106). In one embodiment, the message can be authenticated by a simple password. In this case, government entities would provide a password so that the service station/bank central authority would know that the message is legitimate. This step will aid in keeping the system secure from pranks, hackers, etc. Security measures to authenticate this warning are well known in the art.

The next step in the method C is using source information to provide map and direction information (at 108). This may be initiated by the government entity issuing the warning or, in the alternative, the government entity could issue a general warning and/or evacuation and the POS control station 28 would be responsible for gathering source information to map out a route for evacuation. In either case, the map and direction information would be geared for that particular location at that particular time. Furthermore, this information could be updated by gathering more current source information. For example, the route may call for all individuals to take Interstate 1 to the east. However, when that interstate becomes congested, it may be beneficial for all evacuees to take Interstate 2. In this case, as soon as Interstate 1 becomes ineffective, the warning will recommend Interstate 2. By continuously updating the source information, traffic flow can be monitored in real time. Therefore, this information is always subject to change.

A user may also input information that may impact routing. For example, a user may have a destination that was not initially recommended by the POS control station 28, in which case the POS control station 28 may be programmed to give alternate information that is more akin to the user's demands. A user may also demand an alternative service station 26, for example, because the user's vehicle requires a specialty type of gas that the first service station does not supply. In this respect, two way communication may be facilitated. Two way communication may also include the service station 26 informing the government entity that it is out supply. In this regard, the government entity would act accordingly by sending more supply and/or directing traffic flow to another service station.

The next determination in method C is whether the user will have the information printed (at 110). The user may require that the information be provided to him or her in printed form. The user may also require that the information be downloaded to a handheld device, such as a laptop, PDA, etc. The user may in turn just want the information to be spoken to him or her. It is possible that the service provider, such as gas station and/or bank, may have a fee associated with printing the evacuation information, in which case the user may be asked to decide whether they want this information printed. If the user decides to print the information printed, the user would then select a route (at 112). Because of a variety of routes may be chosen, given different source information, the users will select whichever route is most suitable. Once the user decides on the optimal route, the map is verified and printed (at 114).

Whether or not the user decided to print the map, the user may still need to use the POS station (30, 18, FIG. 1), in which the case upon request, the POS station 30, 18 will resume normal operation (at 116). In one embodiment, it will be required for the user to see the warning message and, therefore, the user would select an information received button. In this form, the POS station would not resume normal operation until this option is selected. This embodiment will increase the likelihood that the user will see and acknowledge the warning message.

The above description merely provides a disclosure of particular embodiments of the invention and is not intended for purposes of limiting the same thereto. As such, the present disclosure is not limited to only the above-described embodiments. Rather, it is recognized that one skilled in the art could conceive alternative embodiments that fall within the scope of the claims.

We claim:

1. A method of delivering emergency directions from the government to potential evacuees on a gas pump or automated teller machine point of service display screen comprising:

receiving an emergency alert from a government entity;

constructing a warning message based on said emergency alert, said warning message including an evacuation route based at least in part on real time traffic data and the location of the user; and displaying said warning message on a point of service display screen;

wherein the warning message includes an estimated travel time associated with the evacuation route.

2. The method according to claim 1 further comprising authenticating said emergency alert with respect to the government entity.

3. The method according to claim 1 wherein said real time traffic data being derived, at least in part, from wireless communication network traffic data.

4. The method according to claim 1 further comprising updating said warning message based at least in part on said real time traffic data.

5. The method according to claim 1 wherein said warning message includes identification of service stations on said evacuation route.

6. The method according to claim 1 wherein said warning message includes a graphical map.

7. The method according to claim 1 further comprising printing said warning message.

8. The method according to claim 1 further comprising facilitating two way communication between a point of service terminal associated with the point of service display screen and said government entity.

9. A method of delivering emergency directions from a government entity, comprising:

receiving a warning message from the government entity, said warning message including information relating to evacuation;

constructing map and direction information for an evacuation route which is based at least in part on the warning message;

providing the warning message and map and direction information to a point of service terminal, the map and direction information based at least in part on a location of the point of service terminal and geared for current time; and making said warning message, map and direction information, and evacuation route selectively accessible to a user at said point of service terminal;

wherein the map and direction information includes an estimated travel time associated with the evacuation route in relation to the location of the point of service terminal.

10. The method according to claim 9 further comprising updating said evacuation route based at least in part on traffic data.

11. The method according to claim 10 wherein said traffic data is based at least in part on wireless communications network traffic data.

12. The method according to claim 9 further comprising a printing at least part of any of said warning message, map and direction information, and evacuation route on a printer associated with the point of service terminal in response to corresponding user selection.

13. A system for delivering emergency directions from the government to potential evacuees, comprising:

a mapping module;

a traffic module configured to gauge traffic flow;

a server module configured to receive information from said mapping module and said traffic module and derive an emergency message with an evacuation route based at least in part on an emergency alert from a government entity and traffic flow; and a point of service terminal in communication with the server module and configured to display at least a portion of the emergency message including said evacuation route on a display screen associated with the point of service terminal;

wherein the emergency message includes an estimated travel time from a location of the point of service terminal to a destination associated with the evacuation route.

14. The system according to claim 13 wherein said traffic module gauges traffic flow based at least in part on monitoring wireless communication network traffic data.

15. The system according to claim 13 further comprising a printer in communication with the point of service terminal and configured to print at least part of said emergency message.

16. The system according to claim 13 wherein said emergency message is displayed on the display screen prior to the point of service terminal beginning normal operation.

17. The system according to claim 16 wherein said emergency message on the display screen must be acknowledged by a user prior to beginning normal operation of said point of service terminal.

18. The system according to claim 13 wherein said emergency message includes a graphical map.

19. A method of delivering emergency directions from a government entity to potential evacuees, comprising:

receiving an emergency alert from the government entity with information relating to evacuation;

constructing a warning message based on the emergency alert, the warning message including an evacuation route selection of which is based at least in part on a current location of a point of service terminal, real time traffic flow conditions, and reduction of traffic congestion in relation to evacuation;

forwarding the warning message to the point of service terminal; and making the warning message accessible to a user at the point of service terminal;

wherein the warning message includes an estimated travel time associated with the evacuation route in relation to the location of the point of service terminal and a destination associated with the evacuation route.

* * * * *